US006315474B1

(12) United States Patent
Giles et al.

(10) Patent No.: US 6,315,474 B1
(45) Date of Patent: Nov. 13, 2001

(54) AUTOMATIC PAPER CUTTER FOR LARGE FORMAT PRINTER

(75) Inventors: Robert Giles, Escondido, CA (US); David Hermida; Tony Lang, both of Sant Cugat Del Valles (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/183,872

(22) Filed: Oct. 30, 1998

(51) Int. Cl.[7] ..... B41J 15/02

(52) U.S. Cl. ..... 400/621; 346/24; 83/485; 83/614

(58) Field of Search ..... 346/24; 400/621, 400/621.1, 621.2; 101/226; 83/483, 484, 485, 563, 578, 582, 583, 614

(56) References Cited

U.S. PATENT DOCUMENTS

| | | | | |
|---|---|---|---|---|
| 4,313,359 | | 2/1982 | Smoravek . | |
| 4,504,162 | * | 3/1985 | Speraggi | 400/621 |
| 4,701,063 | * | 10/1987 | Wysk et al. | 400/621 |
| 4,979,838 | | 12/1990 | Yokota . | |
| 4,981,059 | * | 1/1991 | Kobayashi | 83/76.7 |
| 5,243,890 | * | 9/1993 | Ober | 83/478 |
| 5,296,872 | | 3/1994 | Caamano . | |
| 5,363,123 | * | 11/1994 | Petersen et al. | 346/24 |
| 5,436,646 | | 7/1995 | Schilling et al. . | |

* cited by examiner

*Primary Examiner*—Ren Yan
(74) *Attorney, Agent, or Firm*—Roth & Goldman

(57) ABSTRACT

A paper cutter assembly for a printer/plotter is mounted on the printhead carriage for movement therewith to avoid separate mounting and guide structure. A cutter wheel is mounted in a housing for cam induced movement between a raised inactive position and a lower active position by engagement of a cam element carrier mounted for movement in the cutter housing with structure on the printer chassis. The printer platen has a stationary cutter bar which extends in a channel in the platen transversely of the path of paper movement and has a cutter wheel receiving well at one end of the channel into which the cutter wheel drops without contacting the platen or cutter bar at commencement of a cutting operation. Camming surfaces on the platen engage the side of a cutter drive wheel to move the cutter wheel into engagement with the cutter bar and then to raise the cutter wheel to the proper amount of operational overlap of the cutting edges as the cutter assembly moves across the paper path. The cutter wheel is moved between its inactive and active positions at one side of the media and damage to the cut edge of rollfeed media is prevented by retracting the rollfeed media edge away from the cutter bar as the cutter wheel returns to said one side of the media after a cut.

28 Claims, 11 Drawing Sheets

AUTOMATIC PAPER CUTTER FOR LARGE FORMAT PRINTER

CROSS REFERENCE TO RELATED APPLICATIONS, IF ANY

None.

BACKGROUND OF THE INVENTION AND PRIOR ART

The present invention relates to computer driven printers and, more particularly, to an improved print media cutter. For ease of reference, instead of the term "print media", the term paper will be frequently used herein and is intended to encompass all forms of print media including paper, transparencies, vellum, etc.

The media cutter assembly of the present invention is primarily designed for large scale printers/plotters which receive print media from a roll supply. After printing of a sheet of media from the roll, a clean transverse cut needs to be made without wrinkling of the media and with a minimum of paper positioning or repositioning to cut the printed sheet and, if necessary, the leading edge of the roll may be further trimmed. A variety of prior art cutting mechanisms have been used including stationary full length linear blades in conjunction with moveable rotary cutting blades mounted on a cutter carriage which in turn moves on cutter carriage support rods or guide tracks separate from the printhead carriage and its support rods or tracks. Both manual and automatic systems have been used including the type disclosed in U.S. Pat. No. 5,296,872 issued Mar. 22, 1994 to Caamano and owned by the assignee of the present invention. In this patent a separate cutter carriage is connected, when desired, to the print head carriage for movement therewith and is disconnected from the print head carriage after the cutting operation.

It is the primary object of the present invention to provide a reliable media cutter assembly which is rigidly connected at all times to the print head carriage so that separate print head and cutter carriages and associated guide structure for each are unnecessary.

SUMMARY OF THE INVENTION

The present invention provides a media cutter assembly for attachment to a moveable printhead carriage of a computer driven printer comprising:

a) a cutter wheel support member having a media cutter wheel mounted thereon for rotation about an axis, said support member also including a first cam element;

b) a cam element carrier and cutter actuator moveable generally transversely to said cutter wheel axis, said carrier having a second cam element thereon engaged by said first cam element and said actuator being engageable with cutter actuation means on said printer;

c) a housing having first guide means therein for guiding said cutter wheel support member in a path of movement to move said cutter wheel between inactive and active positions relative to said housing, said housing having second guide means for guiding said cam element carrier relative to said housing in a path of movement generally transverse to said path of movement of said cutter wheel between a cutter inactive position and a cutter active position; and d) means for biasing said cutter wheel support member for movement of said cutter wheel toward said active position relative to said housing.

The present invention further provides a printer having a moveable printhead carriage and a print media cutter assembly attached thereto, said media cutter assembly comprising:

a) a cutter wheel support member having a media cutter wheel mounted thereon for rotation about an axis, said support member also including a first cam element;

b) a cam element carrier and cutter actuator moveable generally transversely to said cutter wheel axis, said carrier having a second cam element thereon engaged by said first cam element and said actuator being engageable with cutter actuation means on said printer;

c) a housing having first guide means therein for guiding said cutter wheel support member in a path of movement to move said cutter wheel between inactive and active positions relative to said housing, said housing having second guide means for guiding said cam element carrier relative to said housing in a path of movement generally transverse to said path of movement of said cutter wheel between a cutter inactive position and a cutter active position; and d) means for biasing said cutter wheel support member for movement of said cutter wheel toward said active position relative to said housing;

said printer having an output platen and a stationary elongated cutter bar in a cutter wheel receiving channel which extends transverse to the path of movement of printed media to be cut, said cutter wheel in said cutter active position being engageable with said cutter bar.

The invention further provides a method of cutting printed media sheets in a printer from a rollfeed supply of media comprising the steps of:

a) moving the printed media in a forward direction across a stationary cutter bar which extends transversely to the direction of movement of the media and then holding said media in a stationary position across said cutter bar;

b) using a printhead carriage having an attached cutter assembly to move said cutter assembly in a first direction to a position at a first side of said media to engage means on said cutter assembly with printer structure at said first side of said media;

c) moving said cutter assembly and printhead carriage in a second direction to first move a cutter blade from an inoperative position to an operative position and subsequently engaging said cutter blade with said cutter bar as said cutter assembly moves from said first side of said media to a second side of said media to cut said media; and d) returning said cutter assembly and printhead carriage in said first direction to said first side of said media while said cutter blade remains engaged with said cutter bar and then moving said cutter blade to said inoperative position.

DESCRIPTION OF THE PREFERRED EMBODIMENT

Figure 1:
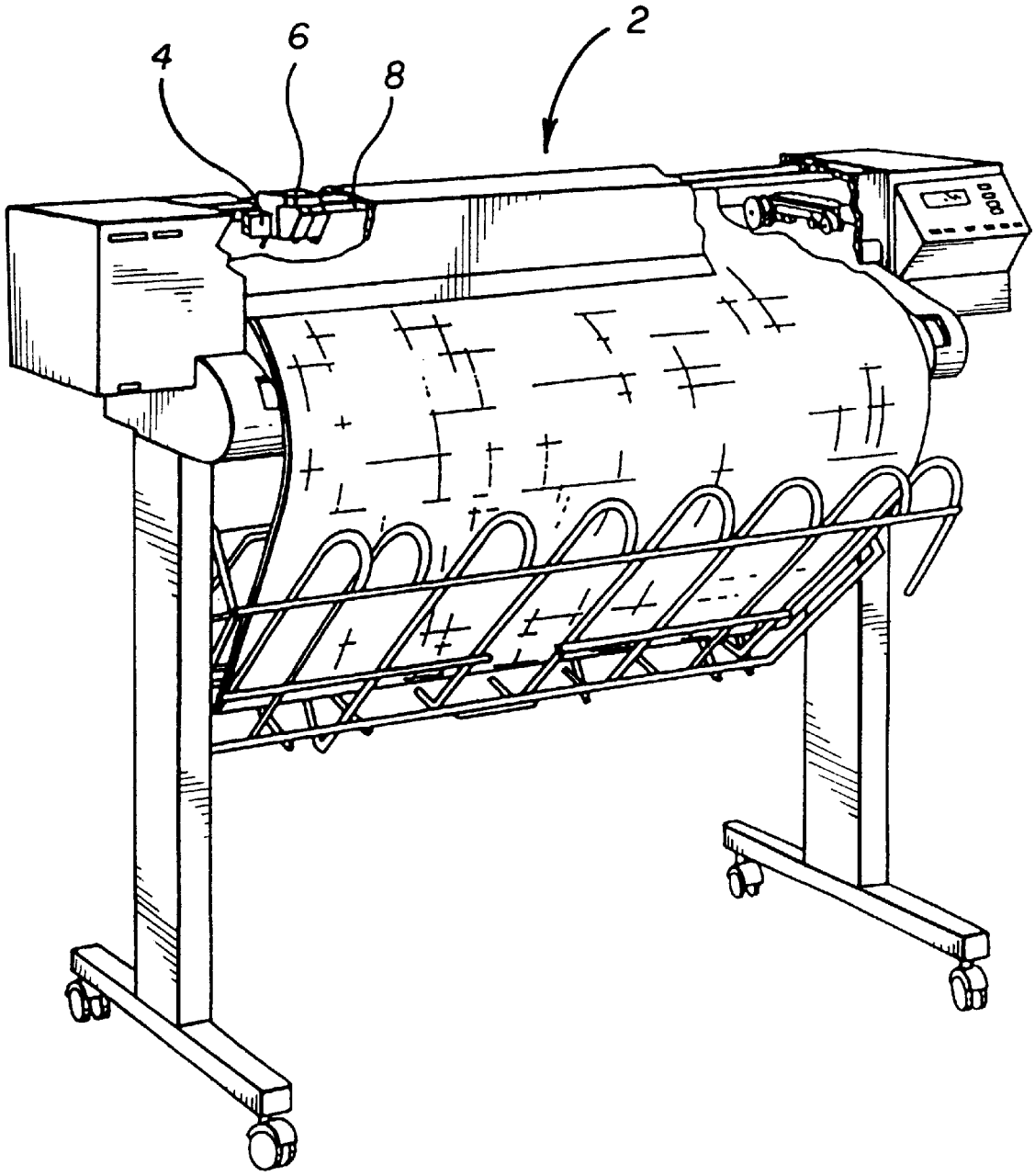
FIG. 1 is a perspective view of a computer driven plotter having a moveable print head carriage and a moveable rotary wheel paper cutter mounted thereon.

The media cutter assembly of the present invention is primarily designed for use in connection with a large scale plotter 2 as shown in FIG. 1; however, the cutter assembly 4 is also adaptable for use with smaller scale printers as well. In FIG. 1 the plotter print head carriage 6 is mounted on slider rods 8. The media cutter assembly 4 of the present invention is attached to and always moves with the print head carriage 6.

Figure 2:
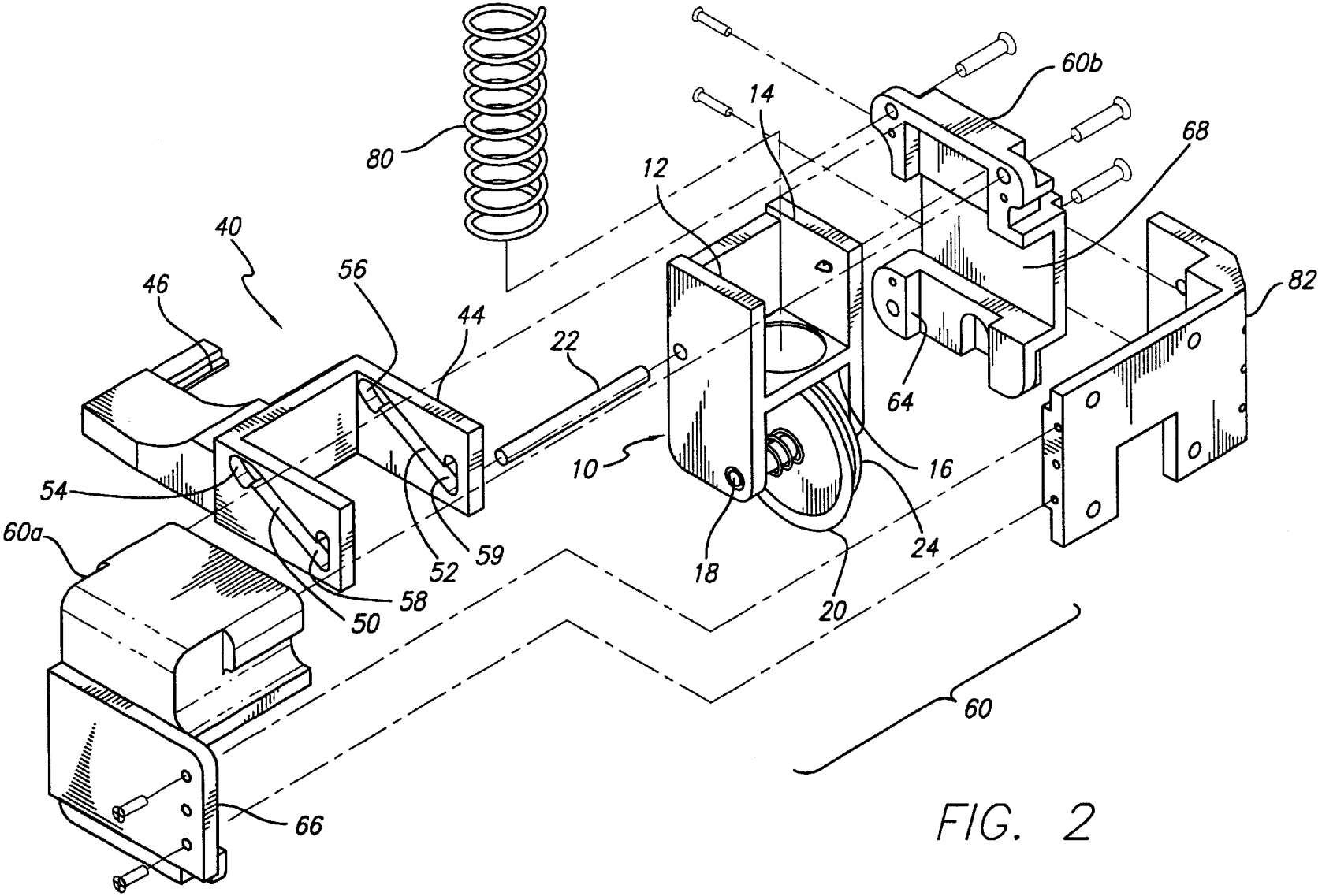
FIG. 2 is an exploded perspective view of the cutter assembly separately showing the rear housing part, the actuation hook and cam element carrier, the vertical bias spring, the cutter holder and the front housing part.

As seen in the exploded view of FIG. 2, the media cutter assembly essentially is comprised of a cutter wheel support member 10, a cam element carrier 40 and a housing 60 having a front part 60*a* and a rear part 60*b* fastened together by screws 60*c* such that the housing 60 contains the cutter wheel support member 10 and the cam element carrier 40, both the cutter wheel support member 10 and the cam element carrier 40 being slideably moveable along mutually perpendicular directions of movement in the housing 60. The cutter wheel support member 10, cam element carrier 40 and housing 60 are all molded plastic parts, the housing having guide rails, channels or tracks for guiding the cutter wheel support member 10 and cam element carrier 40 along their directions of movement.

The cutter wheel support member 10 is comprised of a pair of parallel spaced flanges, 12, 14 interconnected by a transversely extending web 16. The rotatable cutter wheel 20 is mounted on an axle 18 which extends between the flanges 12, 14 on the lower side of the web 16. A rotatable cutter drive wheel 24 is also mounted on the same axle 18 with the cutter wheel 20 and drive wheel 24 is affixed to the cutter wheel 20.

Figure 7:
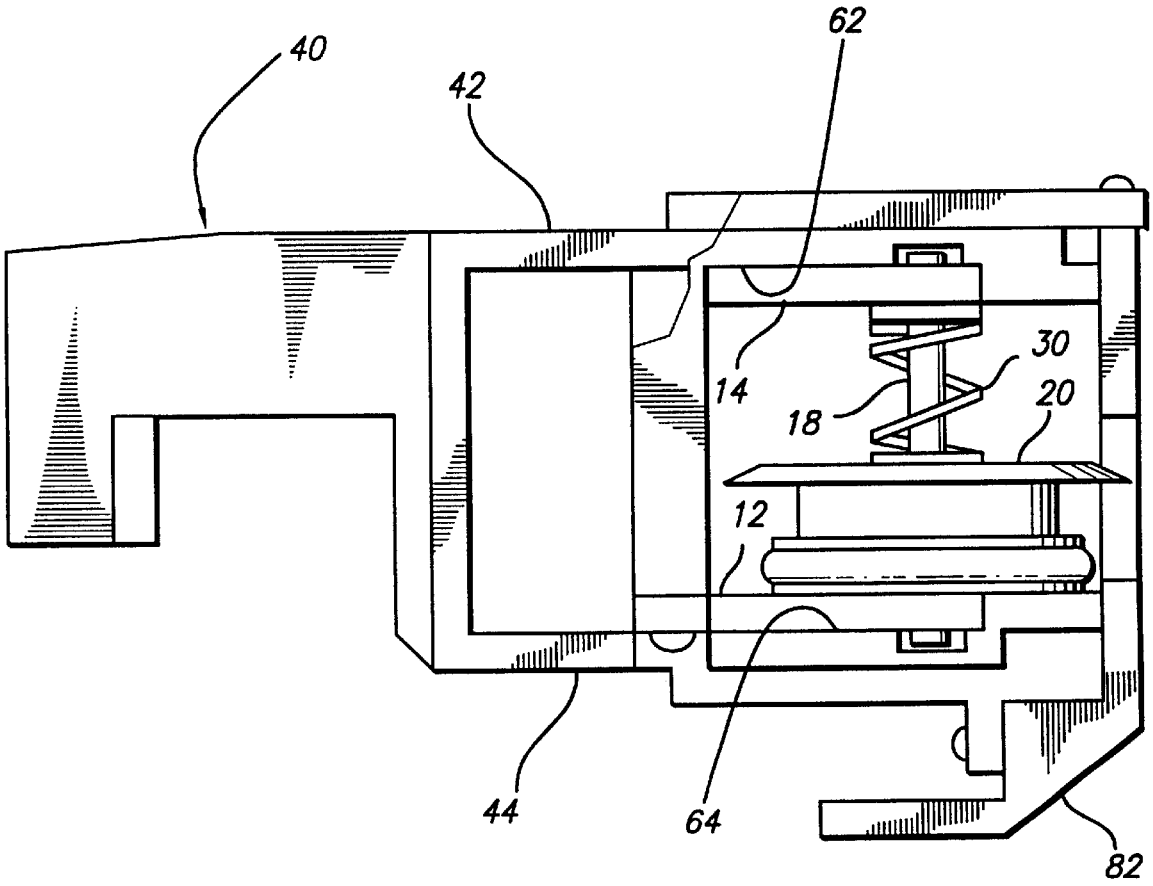
FIG. 7 is a bottom plan view of the cutter.

The parallel cutter wheel support flanges 12, 14 are respectively guided in spaced parallel tracks or guideways 62, 64 in the housing 60 (FIG. 7) for movement of the cutter wheel support member 10 and attached cutter wheel in a generally vertical path as shown. A coil compression spring 80 is seated between the web 16 and an interior upper wall the housing 60 such the cutter wheel support member and cutter wheel is biased downwardly to a lower cutter wheel active position. Preferably, the upper interior wall of the housing 60 and the web 16 may be provided with suitable indentations or projections to provide seats which present lateral movement of the ends of the spring 80.

The cam element carrier 40 includes a pair of parallel spaced flanges 42, 44 each having an elongated cam track 50, 52 therein. The housing 60 includes guide tracks 66, 68 which respectively receive the flanges 42, 44 of the cam element carrier to guide the cam element carrier for movement in the guide tracks 66, 68. As shown in the drawings, the guide tracks 62, 64 for the cutter support member 10 and the guide tracks 66, 68 for the cam element carrier 40 are substantially perpendicular to each other although other arrangements are contemplated and within the broader aspects of the invention.

In the preferred embodiment the cutter wheel support member 10 has a transversely extending cam follower rod 22 mounted between the flanges 12, 14, the rod 22 having follower portions near its supported ends which are respectively received in the spaced cam tracks 50, 52. It will be noted that the cam tracks each include a seat 54, 56 at the upper ends thereof as seen in the drawings to receive and seat the follower portions of the rod 22 therein when the cutter wheel 20 is in an upper, inactive position in which the cam tracks 50, 52 and the cutter wheel 20 are substantially enclosed by the walls of the housing 60.

Figure 3:
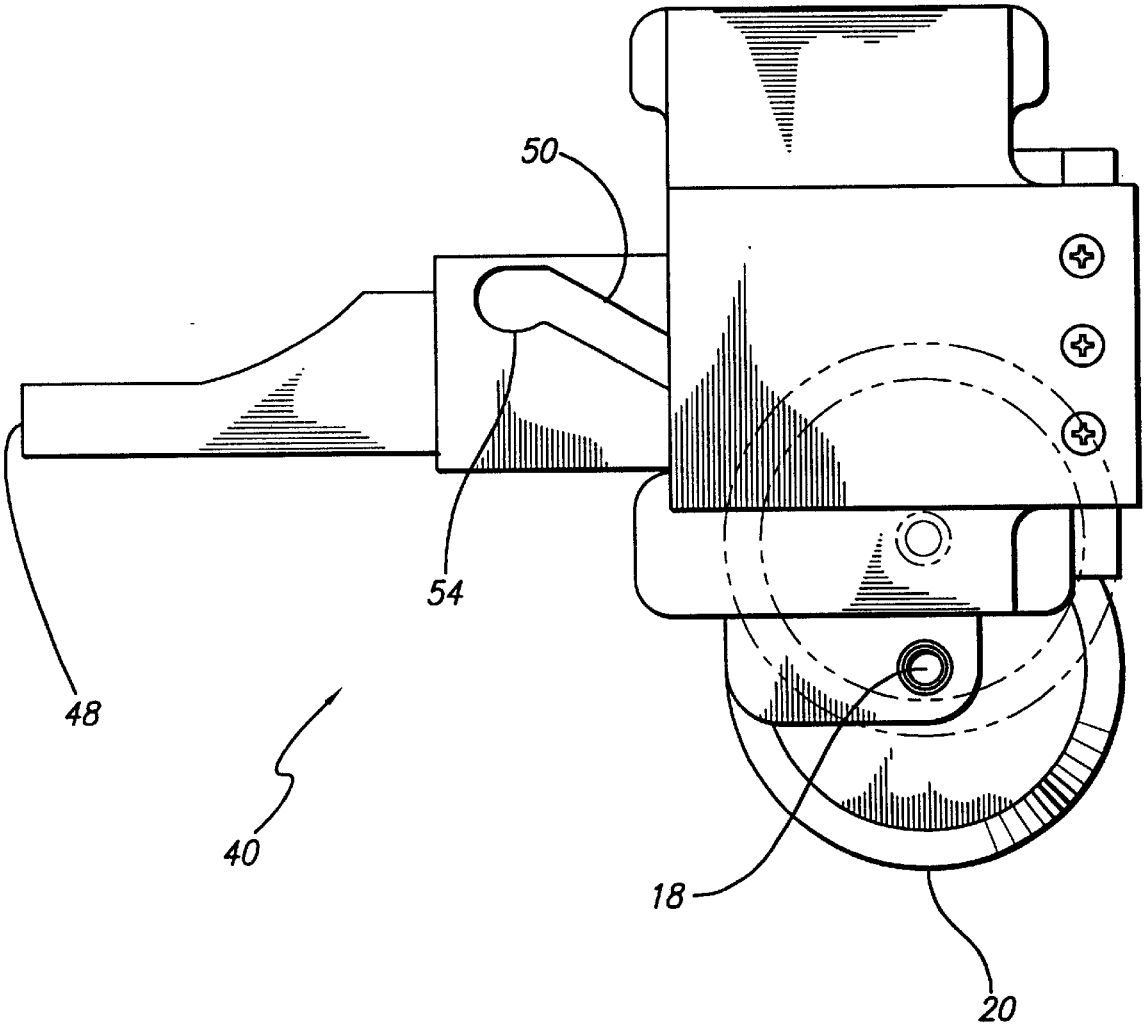
FIG. 3 is a front elevation view showing the cutter wheel in a lowered or active position and showing, in phantom, the cutter wheel in an upper inactive position.

Each cam track 50, 52 has essentially the same configuration including a centrally elongated portion which is angled with respect to the direction of movement of the cutter wheel support member, the tracks 50, 52 extending generally downwardly to the right as seen in FIG. 3 from the seats 54, 56 toward the cutter wheel axle 18. The cam tracks 50, 52 then terminate in a second seat 58, 59 comprising a slightly upwardly extending portion of the cam track which thus extends parallel to the direction of movement of the cutter wheel support. The upwardly extending seats 58, 59 of the cam tracks permit spring biased vertical movement of the cutter wheel 20 relative to the cutter wheel support member 10 when the cutter wheel is in the active position such that the cutter wheel may engage a stationary elongated cutter bar (shown in phantom in FIG. 4) on the output platen of the plotter as is conventional. The vertical extent of the cam tracks and spring biased movement of the cutter wheel permits the cutter wheel to accommodate slight variations in the platen surface from end to end of the path cutter travel across the media to be cut.

Figure 4:
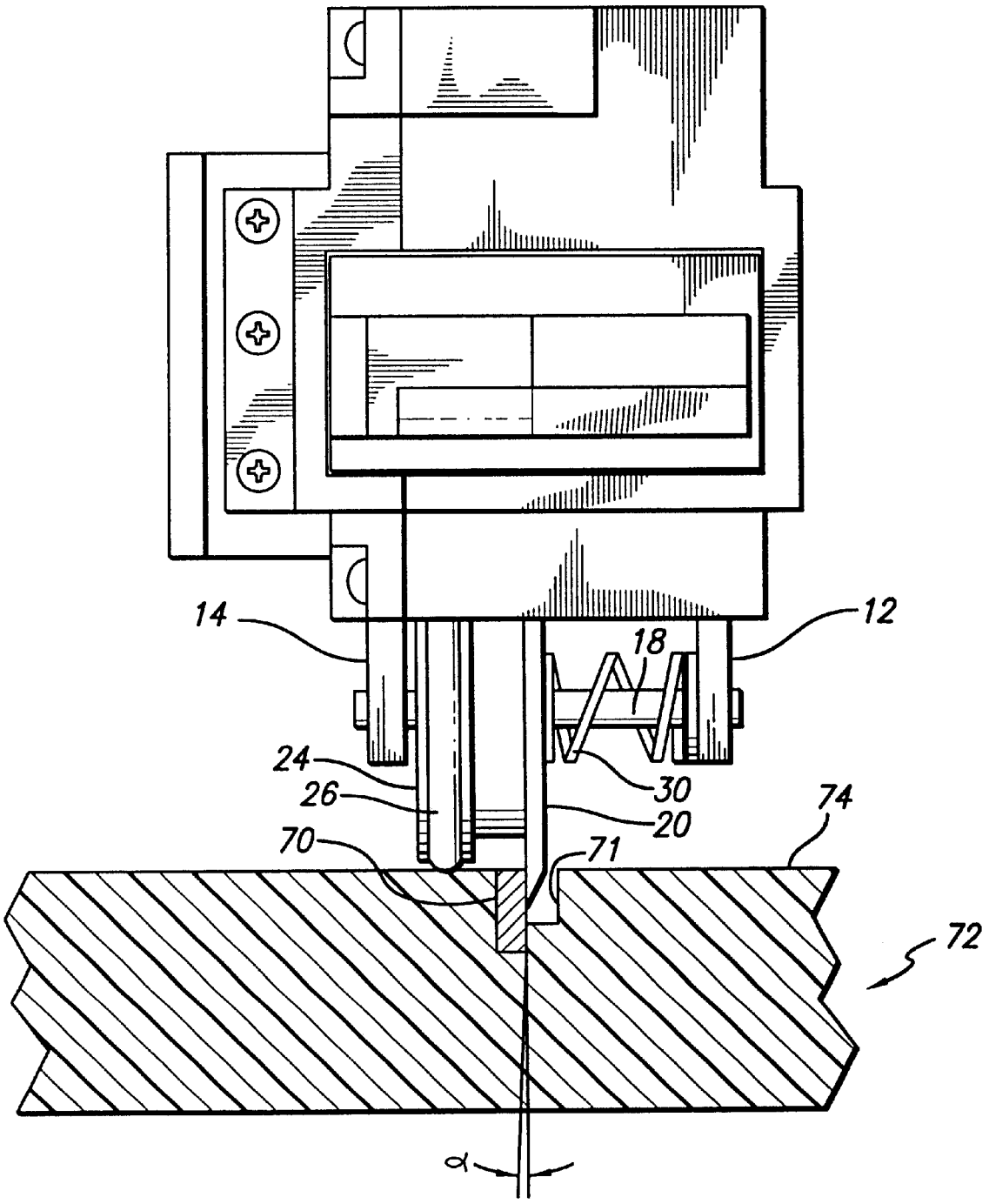
FIG. 4 left side elevation view of the cutter.
Figure 5:
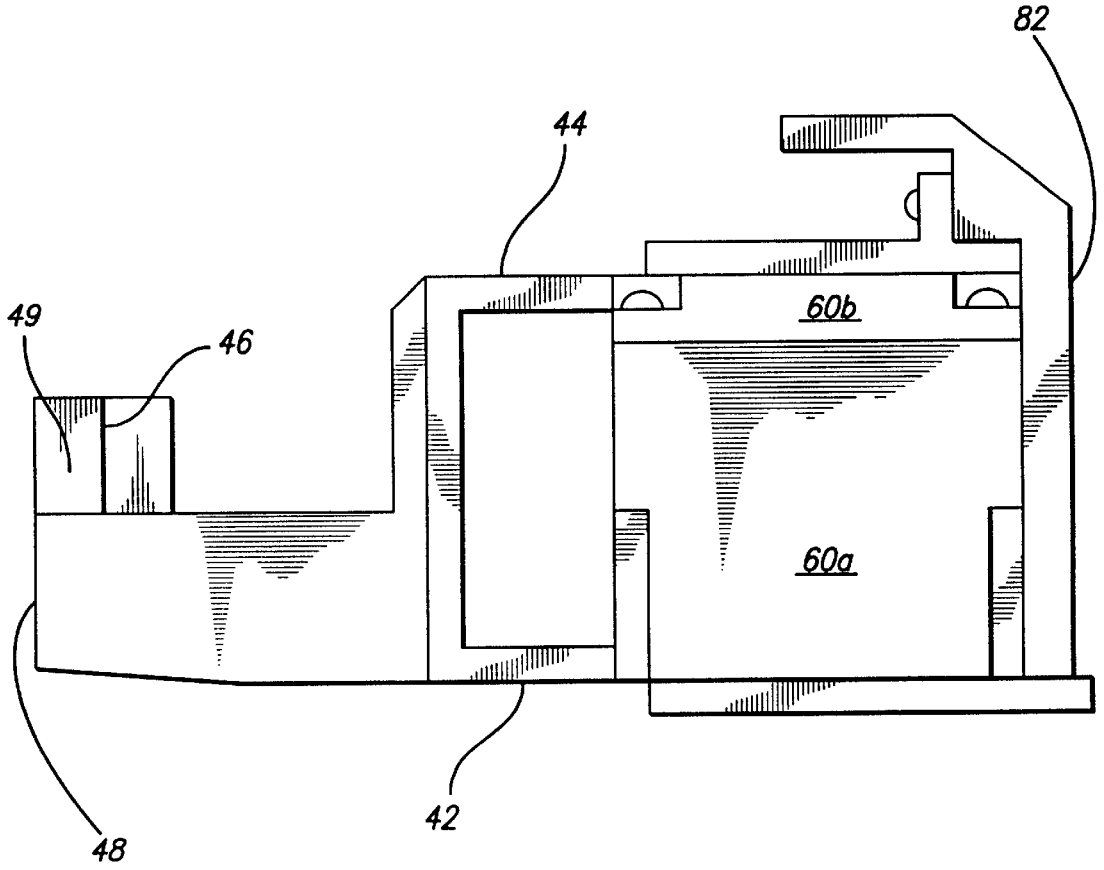
FIG. 5 is a top plan view of the cutter.
Figure 6:
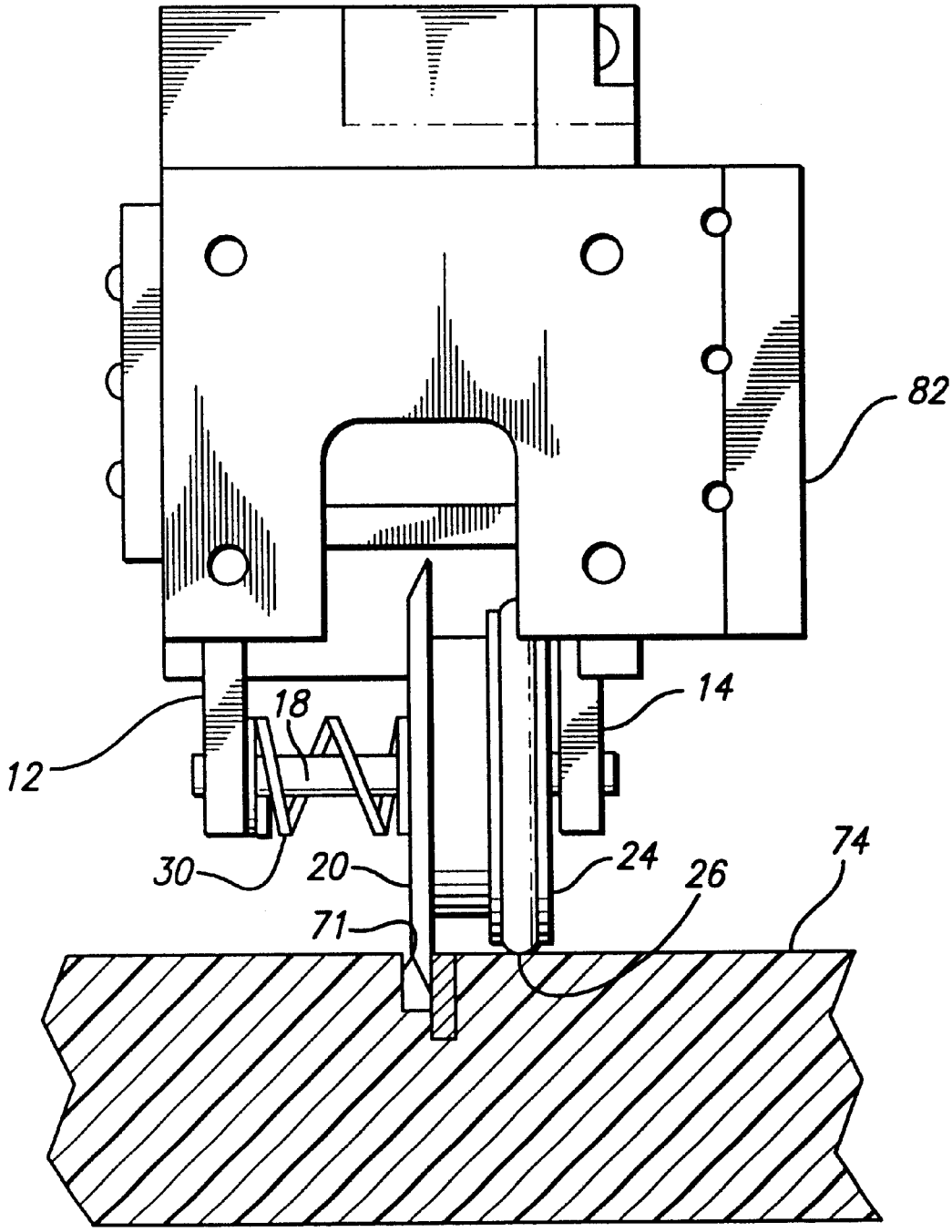
FIG. 6 is a right side elevation view of the cutter.

Also as seen in FIG. 4, the cutter drive wheel 24 preferably has an elastomeric tire 26 of smaller diameter than the cutter wheel. Both the cutter drive wheel 24 and the cutter wheel 20 are mounted on a common axle 18 with a compression spring 30 which axially biases the cutter wheel and cutter drive wheel toward one (14) of the cutter wheel support flanges 12, 14. As shown, the cutter drive wheel is affixed to the side of the cutter wheel 20 opposite from the side of the cutter wheel engaged by the spring 30 such that the spring 30 biases the cutter wheel 20 toward the stationary cutter bar.

Figure 8:
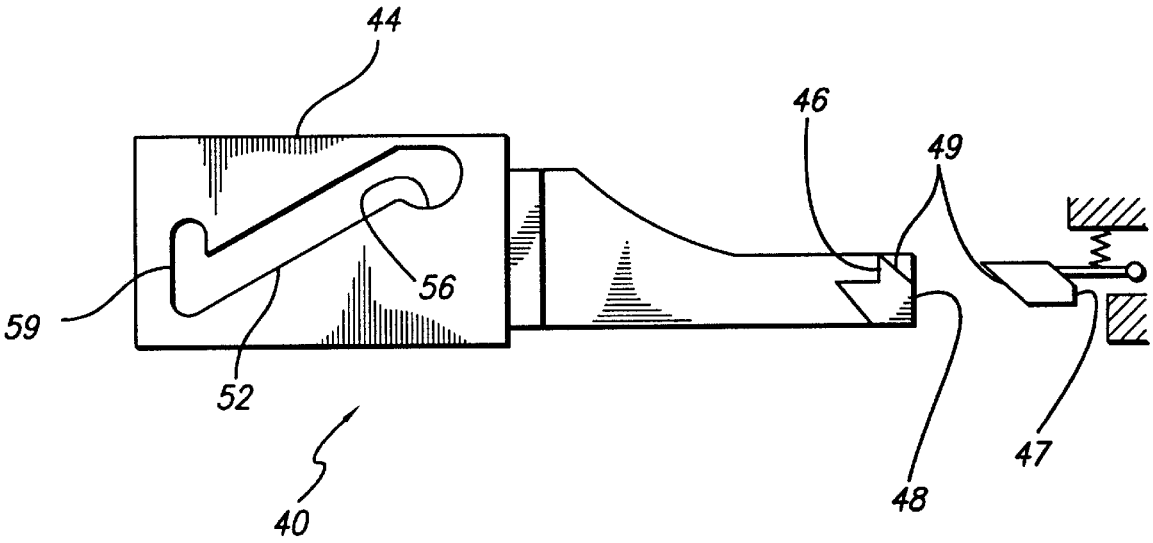
FIG. 8 is a rear elevation view of the cutter actuation hook.

The cam element carrier 40 includes a laterally extending arm having an actuation hook 46 (FIG. 8) thereon having a substantially vertically extending hook surface which is engageable with substantially vertically extending surface of a spring biased actuation hook 47 shown schematically on the printer chassis when a cutting operation is desired. Hooks 46 and 46 each have complementary beveled cam surfaces 49 thereon as shown. An abutment 48 surface on the end of the arm is engageable with a stationary portion of the printer structure to move the cutter wheel 20 from its active, lowered position to an upper, inactive position where the cutter wheel is substantially stored inside the housing 60.

Suitable means such as a mounting bracket 82 are provided for affixing the cutter assembly housing 60 to the moveable print head carriage.

Figure 9:
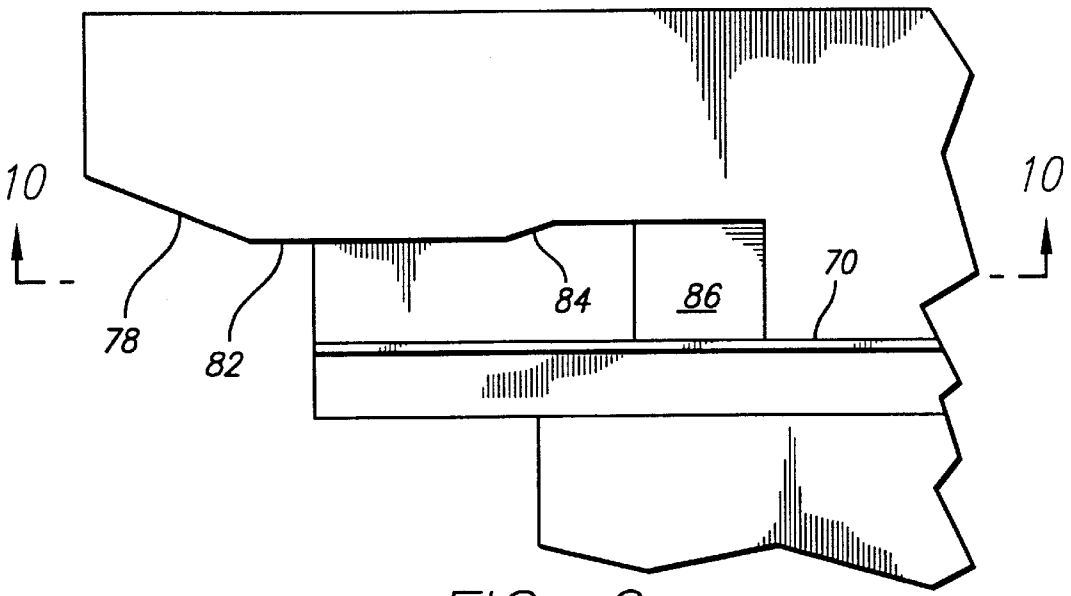
FIG. 9 is a top plan view of the end of a platen and stationary cutter bar.
Figure 10:
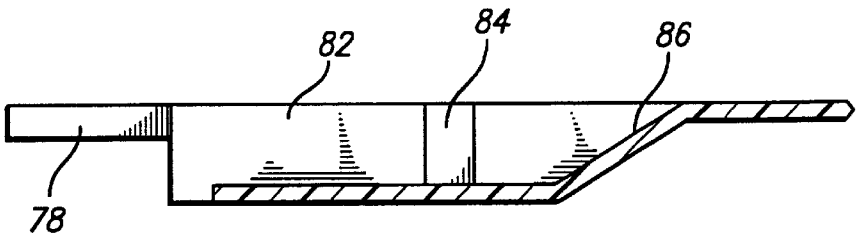
FIG. 10 is a vertical section of the platen taken at lines 10—10 on FIG. 9.
Figure 11:
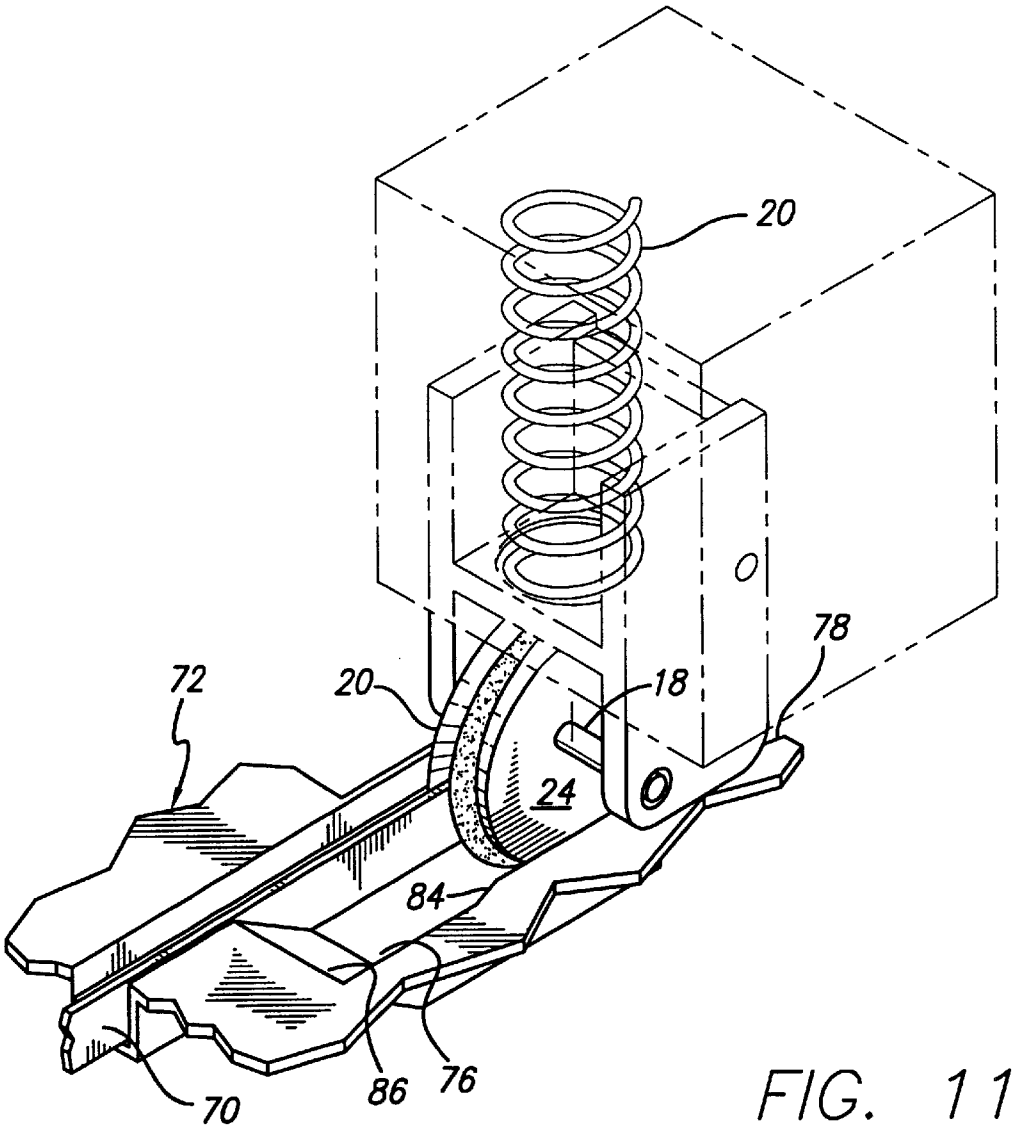
FIG. 11 is a perspective showing the relationship of the moveable cutter and platen.

The printer/plotter 2 has a stationary output platen 72 of molded plastic which has an elongated cutter bar 70 mounted in a cutter wheel receiving channel 71 in the platen which extends downwardly from the upper surface 74 of the platen in a direction transverse to the path of movement of paper through the printer/plotter 2. As seen in FIGS. 9–11, the left end of the platen 72 has a cutter wheel well 76 therein into which the cutter wheel 20 and drive wheel 24 drop freely without contact with the platen 72 or cutter bar 70. A first horizontally extending angled cam surface 78 is provided to engage the side of drive wheel 24 and move the attached drive wheel 24 and cutter wheel 26 axially toward the front of the printer against the bias of spring 30 as the cutter assembly moves to the right. This permits the rotary cutter wheel 20 from contacting the end of the stationary cutter bar 70. After the cutter wheel moves further to the right past a guide surface 82 on the platen with which the side of drive wheel 24 is still engaged, the side of drive wheel 24 engages a second horizontally extending angled cam surface 84 which allows cutter wheel 20 to come into contact with the front side of the stationary cutter bar 70. Continued movement of the cutter assembly to the right causes the tire 26 on drive wheel 24 to engage a vertically inclined ramp 86 to lift the edge of cutter wheel to the proper operational amount of overlap with the top of the cutter bar 70 and upper surface 74 of platen 72.

Figure 12:
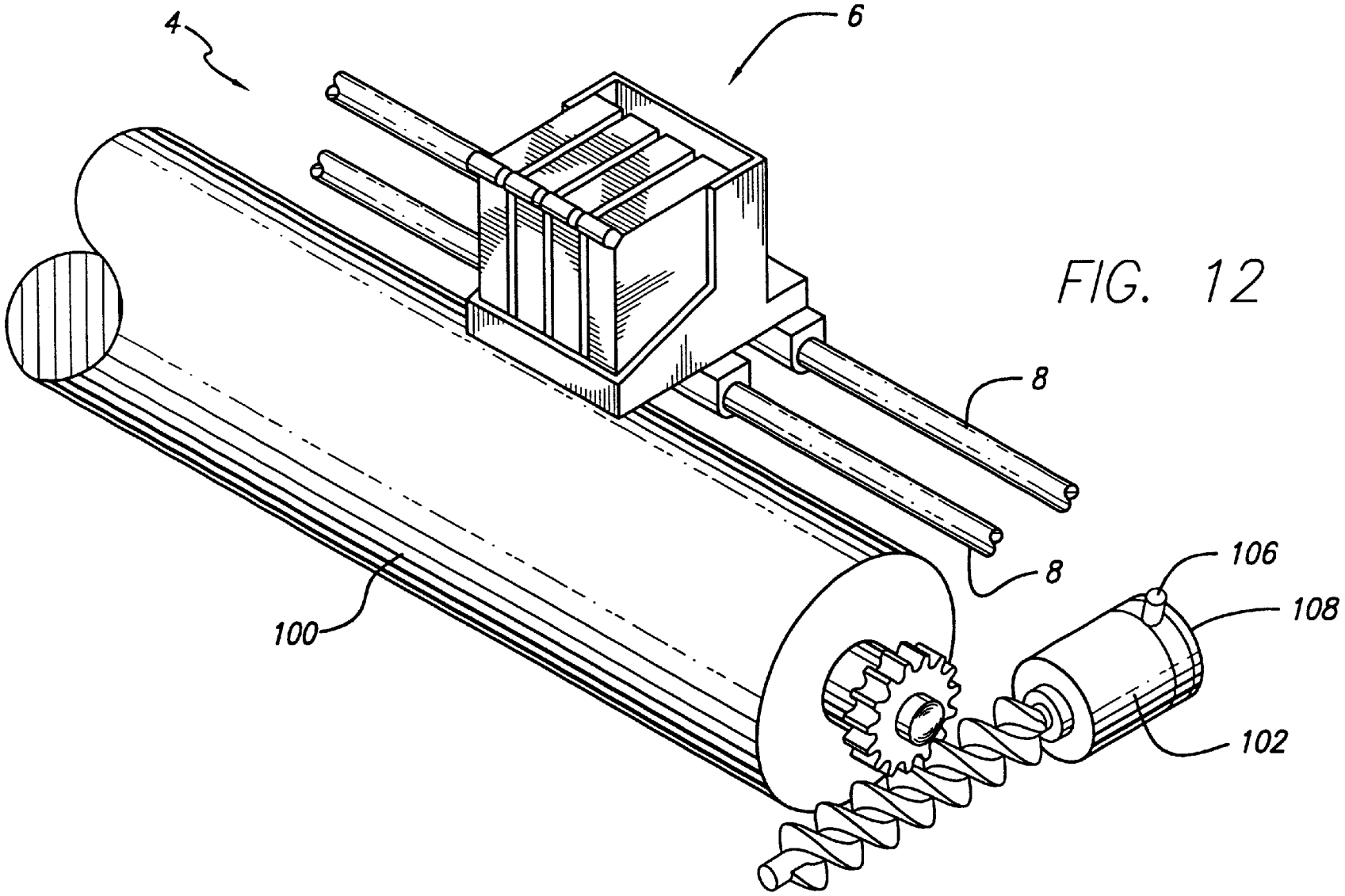
FIG. 12 is a perspective view of a media positioning roller and drive therefor, a printhead and cutter carriage being shown in phantom.

FIG. 12 shows, in perspective, a cylindrical media drive roller 100 which is driven by a reversible motor 102 having a rotary output shaft 104 which is connected by a transmission to the drive roller 100 to permit rotation of the drive roller 100 in a forward or media feed direction and a reverse or media retraction direction after a sheet of printed media has been cut from the supply roll as will be described. The position of the media may be sensed by an optical reader 106 and an encoder 108 on the motor 102. The optical reader 106 produces a series of output pulses which indirectly determines the position of the media roller 100 and hence the position of the media.

In operation, the media cutter assembly always moves with the moveable print head carriage which makes it unnecessary to have an additional cutter carriage and cutter carriage supports. This further allows the cutting edge of the rotary cutter wheel 20 to be very close to the print zone. Accordingly, in a printer equipped with the cutter assembly shown herein, the distance the media must be fed for a cutting operation may be minimized.

When a cutting operation is desired, the print head carriage 6 is moved a distance beyond the end of the length of its path of travel during printing to a position on one side of the printer (the left side as shown in FIGS. 1 and 12) where beveled surfaces 49 cross over each other and the vertical surface of the hook 46 now becomes engaged with the vertical surface of the moveable actuation hook 47 on the printer. The carriage then moves to the right during which time the engaged hook surface of hook 46 pulls the cam element carrier 40 to the left with respect to the housing thus allowing the cutter wheel support member 10 to drop the cutter wheel 20 from its inactive stored position into the well 76 as the follower rod 22 moves out of the seats 54, 56 and follows the tracks 50, 52 assisted by the bias of spring 80 to the vertically extending seats 58, 59. After the cam element carrier is pulled out of the housing to the left to its full extent of travel with respect to the cutter housing 60, hook 46 automatically disengages from the actuation hook 47 on the printer as the printhead carriage and attached cutter assembly continue to move to the right to perform a cutting operation. The cutter wheel 20 is then moved form the well 76 to the cutting position as described above with reference to FIGS. 9–11. Cutter wheel 20 is rotated by its fixed engagement with the cutter drive wheel 24 and engagement of the elastomeric tire 26 with the surface of the media to be cut which is supported on upper surface 74 of the platen 72. As cutter wheel 20 reaches the right end of its path of travel after the cut, the direction of motor 102 is reversed to cause leading edge of the roll of print media to be moved by the media roller 100 slightly rearwardly away from the cutter wheel 20 to an extent such that the cutter wheel 20 will not engage the previously cut edge of the media as the cutter retreats back across the media path toward the left end of its path of travel. As the connected print head carriage and media cutter assembly reach the left side of the printer after a completed cutting operation, the above sequence is reversed whereby the cutter wheel drops into the well 76 and the abutment 48 on the end of the cam element carrier arm then engages a stationary portion of the printer chassis thus pushing the cam element carrier 40 back to the right into the housing 60 automatically raising the cutter wheel support member 10 and cutter wheel 20 to its inactive position as the follower rod moves from seats 58, 59 along the tracks 50, 52 to the seats 54, 56.

Preferably, the rotary cutter wheel 20 is mounted such that it is not co-planar with the linear blade. A slight angle $\alpha$ between the blades (FIG. 4) is desirable for optimal cut quality.

Persons skilled in the art will readily appreciate that various modifications can be made from the preferred embodiment thus the scope of protection is intended to be defined only by the limitations of the appended claims.

What is claimed is:

1. A printer having a chassis and a moveable printhead carriage and a print media cutter assembly attached thereto, said media cutter assembly comprising:

a) a cutter wheel support member having a media cutter wheel mounted thereon for rotation about an axis, said support member also including a first cam element;

b) a cam element carrier and cutter actuator moveable generally transversely to said cutter wheel axis, and carrier having a second cam element thereon engaged by said first cam element and cutter actuation and de-actuation means on said actuator;

c) cutter actuation and de-actuation means on said printer chassis at one end of a path of travel of said printhead carriage, said cutter actuation and de-actuation means on said actuator being engageable with said cutter actuation and de-actuation means on said printer chassis at one end of a path of travel of said printhead carriage;

d) a housing having first guide means therein for guiding said cutter wheel support member in a path of movement to move said cutter wheel between inactive and active positions relative to said housing, said housing having second guide means for guiding said cam element carrier relative to said housing in a path of movement generally transverse to said path of movement of said cutter wheel between a cutter inactive position and a cutter active position; and e) means for biasing said cutter wheel support member for movement of said cutter wheel toward said active position relative to said housing;

said printer having an output platen and a stationary elongated cutter bar in a cutter wheel receiving channel which extends transverse to the path of movement of printed media to be cut, said cutter wheel in said cutter active position being engageable with said cutter bar.

2. The printer of claim 1, further comprising a rotatable cutter drive wheel affixed to said cutter wheel and mounted on an axle, a cutter wheel receiving well at one end of said channel in said platen, and said platen having camming surfaces engageable with said drive wheel for moving said cutter wheel from said well into engagement with one side of said cutter bar.

3. The printer of claim 2, wherein said camming surfaces on said platen first move said cutter wheel axially into engagement with said cutter bar then move cutting edges of said cutter wheel and cutter bar to the desired amount of operational overlap as said cutter assembly moves said cutter wheel in said channel to perform a cut.

4. The printer of claim 3, wherein said cam element carrier includes a pair of parallel spaced flanges each having a cam track therein and said second guide means comprises spaced second tracks in said housing, said cam element carrier flanges being received in said second tracks.

5. The printer of claim 4, wherein said cam track is angled with respect to the direction of movement of said cutter wheel support member from a seat at one end of said cam track toward said cutter wheel axis and terminates in a section which extends in the direction of movement of said cutter wheel support away from said cutter wheel axis to permit spring biased movement of said cutter wheel in the direction of movement of said cutter wheel support member when said cutter wheel is in said active position.

6. The printer of claim 1, wherein said cutter wheel is mounted such that it is non co-planar with the cutter bar whereby said cutter wheel engages said cutter bar at an angle.

7. The printer of claim 3, wherein said cutter wheel engages said cutter bar in both directions of movement of said cutter wheel along said cutter bar.

8. A media cutter assembly for attachment to a moveable printhead carriage of a computer driven printer comprising:

a) a cutter wheel support member having a media cutter wheel mounted thereon for rotation about an axis, said support member also including a first cam element;

b) a cam element carrier and cutter actuator moveable generally transversely to said cutter wheel axis, said carrier having a second cam element thereon engaged by said first cam element and said actuator including cutter actuation and de-actuation means at one side of said actuator;

c) a housing having first guide means therein for guiding said cutter wheel support member in a path of movement to move said cutter wheel between inactive and active positions relative to said housing, said housing having second guide means for guiding said cam element carrier relative to said housing in a path of movement generally transverse to said path of movement of said cutter wheel between a cutter inactive position and a cutter active position; and d) means for biasing said cutter wheel support member for movement of said cutter wheel toward said active position relative to said housing.

9. The media cutter assembly of claim 8, wherein said cutter wheel support member includes a pair of parallel flanges and a transverse web extending between said flanges, said cutter wheel being mounted on an axle extending between said flanges on one side of said web and further comprising a rotatable cutter drive wheel mounted on said axle, said cutter drive wheel being engageable with media to be cut.

10. The media cutter assembly of claim 9, wherein said first guide means comprises spaced first tracks in said housing and said cutter wheel support flanges are received in said first tracks.

11. The media cutter assembly of claim 10, wherein said means for biasing said cutter wheel support member comprises a spring seated between said web and said housing.

12. The media cutter assembly of claim 10, wherein said cam element carrier includes a pair of parallel spaced flanges each having a cam track therein and said second guide means comprises spaced second tracks in said housing, said cam element carrier flanges being received in said second tracks.

13. The media cutter assembly of claim 12, wherein said first tracks and said second tracks are substantially perpendicular to each other.

14. The media cutter assembly of claim 13, wherein said cutter wheel and said cam tracks are substantially enclosed by walls of said housing when said cutter wheel is in said inactive position.

15. The media cutter assembly of claim 14, wherein said first cam element is a follower and said cam tracks each include a first seat at one end which receives said follower to provide an initial resistance to movement of said cam element carrier with respect to said housing.

16. The media cutter assembly of claim 15, wherein said cam track is angled with respect to the direction of movement of said cutter wheel support member from said first seat toward said cutter wheel axis and terminates in a second seat which extends in the direction of movement of said cutter wheel support away from said cutter wheel axis to permit spring biased movement of said cutter wheel in the direction of movement of said cutter wheel support member when said cutter wheel is in said active position.

17. The media cutter assembly of claim 15, wherein said cutter actuation means comprises a hook engageable with actuation means on said printer to move said cutter wheel from said inactive position to said active position and said de-actuation means comprises an abutment engageable with said printer to move said cutter wheel from said active position to said inactive position.

18. The media cutter assembly of claim 9, further comprising means for axially biasing said cutter wheel toward one of said cutter wheel support flanges.

19. The media cutter assembly of claim 18, wherein said means for biasing comprises a compression spring mounted on said cutter wheel axle and said spring being engageable with one of said flanges on said cutter wheel support member.

20. The media cutter assembly of claim 19, wherein said cutter drive wheel is affixed to one side of said cutter wheel and said spring engages an opposite side of said cutter wheel.

21. The media cutter assembly of claim 20, wherein said drive wheel includes an elastomeric tire which is of smaller diameter than said cutter wheel.

22. The media cutter assembly of claim 8, further comprising mounting means affixed to said housing for attaching said housing to a moveable printhead carriage.

23. A media cutter assembly for attachment to a moveable printhead carriage of a printer comprising:

a) a cutter wheel support member having a media cutter wheel mounted thereon for rotation about an axis;

b) a cutter actuator moveable generally transversely to said cutter wheel axis, said actuator including cutter actuation and de-actuation means on one side of said actuator, c) a guide for guiding said cutter wheel support member in a path of movement to move said cutter wheel between inactive and active positions; and d) means engageable with said guide for biasing said cutter wheel toward said active position.

24. The media cutter assembly of claim 23, wherein said cutter actuation means comprises a hook engageable with actuation means on said printer to move said cutter wheel from said inactive position to said active position and said cutter de-actuation means comprises an abutment engageable with said printer to move said cutter wheel from said active position to said inactive position.

25. A printer having a moveable printhead carriage and a print media cutter assembly attached thereto, said media cutter assembly comprising:

a) a cutter wheel support member having a media cutter wheel mounted thereon for rotation about an axis;

b) a cutter actuator moveable generally transversely to said cutter wheel axis, said actuator including cutter actuation and de-actuation means on one side of said actuator;

c) cutter actuation and de-actuation means on said printer;

d) said cutter actuation and de-actuation means on said actuator being engageable with said cutter actuation and de-actuation means on said printer for moving said cutter wheel between active and inactive positions;

e) a guide for guiding said cutter wheel support member in a path of movement to move said cutter wheel between inactive and active positions; and f) means engageable with said guide for biasing said cutter wheel support member toward said active position, said printer having an output platen and a stationary elongated cutter bar in a cutter wheel receiving channel which extends transverse to the path of movement of printed media to be cut, said cutter wheel in said cutter active position being engageable with said cutter bar.

26. The printer of claim 25, wherein said cutter actuation means comprises a hook engageable with said actuation means on said printer to move said cutter wheel from said inactive position to said active position and said cutter de-actuation means comprises an abutment engageable with said printer to move said cutter wheel from said active position to said inactive position.

27. The printer of claim 26, further comprising a rotatable cutter drive wheel affixed to said cutter wheel and mounted on an axle, a cutter wheel receiving well at one end of said channel in said platen, and said platen having camming surfaces engageable with said drive wheel for moving said cutter wheel from said well into engagement with one side of said cutter bar.

28. The printer of claim 27, wherein said camming surfaces on said platen first move said cutter wheel axially into engagement with said cutter bar then move cutting edges of said cutter wheel and cutter bar to the desired amount of operational overlap as said cutter assembly moves said cutter wheel in said channel to perform a cut.

* * * * *